US011585225B2

(12) United States Patent
Skura et al.

(10) Patent No.: US 11,585,225 B2
(45) Date of Patent: Feb. 21, 2023

(54) BLADE FOR A TURBOMACHINE

(71) Applicant: MTU Aero Engines AG, Munich (DE)

(72) Inventors: Krzysztof Skura, Majdan Krolewski (PL); Christian Eichler, Olching (DE); Lutz Friedrich, Munich (DE)

(73) Assignee: MTU Aero Engines AG, Munich (DE)

( * ) Notice: Subject to any disclaimer, the term of this patent is extended or adjusted under 35 U.S.C. 154(b) by 0 days.

(21) Appl. No.: 17/171,769

(22) Filed: Feb. 9, 2021

(65) Prior Publication Data

US 2021/0246794 A1 Aug. 12, 2021

(30) Foreign Application Priority Data

Feb. 11, 2020 (EP) ..... 20156506

(51) Int. Cl.
*F01D 5/14* (2006.01)

(52) U.S. Cl.
CPC ..... *F01D 5/147* (2013.01)

(58) Field of Classification Search
CPC . F01D 5/147; F01D 5/16; F01D 11/10; F01D 5/225; F05D 2260/941
See application file for complete search history.

(56) References Cited

U.S. PATENT DOCUMENTS

| | | | | |
|---|---|---|---|---|
| 5,083,903 | A * | 1/1992 | Erdmann | F01D 5/286 29/889.7 |
| 8,192,166 | B2 * | 6/2012 | Beeck | F01D 5/225 415/173.6 |
| 9,879,550 | B2 | 1/2018 | Plante | |
| 9,963,980 | B2 | 5/2018 | Negri et al. | |
| 10,087,765 | B2 * | 10/2018 | Balliel | F01D 25/08 |
| 2015/0017003 | A1 * | 1/2015 | Shaffer | F01D 5/225 416/182 |
| 2015/0023793 | A1 * | 1/2015 | Bensalah | F01D 5/225 416/193 A |
| 2016/0237829 | A1 * | 8/2016 | Kozdras | F04D 29/388 |
| 2017/0114648 | A1 * | 4/2017 | Chouhan | F01D 9/02 |
| 2018/0016918 | A1 * | 1/2018 | Skura | F01D 11/003 |

FOREIGN PATENT DOCUMENTS

| | | | |
|---|---|---|---|
| DE | 102009030566 | A1 | 12/2010 |
| EP | 1413712 | A1 | 4/2004 |
| EP | 3269932 | A1 | 1/2018 |
| EP | 3314093 | B1 | 4/2019 |
| FR | 3077600 | A1 | 8/2019 |
| WO | 2014105533 | A1 | 7/2014 |

* cited by examiner

*Primary Examiner* — Kurt Philip Liethen
(74) *Attorney, Agent, or Firm* — Barlow, Josephs & Holmes, Ltd.; David R. Josephs

(57) ABSTRACT

The invention refers to a blade for a turbomachine comprising a shroud which is positioned on a tip side of the blade having an outer surface having at least one circumferential web arranged thereon, at least one pocket recessed in the outer surface and a hardfacing provided on at least one edge of the shroud wherein a pocket recessed in the outer surface is arranged adjacent to the hardfacing and a side face of the pocket joins the supporting wall with a radius corresponding at least to the length of the shorter extension of the supporting wall and at most to 1.5 times the length of the larger extension of the supporting wall.

14 Claims, 2 Drawing Sheets

BLADE FOR A TURBOMACHINE

BACKGROUND OF THE INVENTION

The present invention refers to a blade for a turbomachine comprising a shroud which is positioned on a tip side of the blade having an outer surface with at least one circumferential web arranged thereon, at least one first pocket recessed in the outer surface and a hardfacing provided on at least one edge of the shroud.

Blades for turbomachines comprising a shroud which is positioned on a blade tip side of the blade are known in the prior art. In some embodiments, in order to achieve a good damping of vibrations, the blades are arranged next to each other and contact each other at contact areas arranged at edges of the shroud. These contact areas are often provided with a hardfacing in order to keep mechanical abrasion at a low level. While good vibration qualities are achievable by providing the blades with an outer shroud, the weight or mass of the shroud itself increases the centrifugal load on the blade during rotation around the engine axis, thereby causing higher stresses in the blade root and the airfoil. Hence, the weight or mass and in particular the balance of the weight or mass of the outer shroud contribute significantly to the load and stresses acting on a blade. Therefore, the weight or mass of the outer shroud has a substantial influence on excessive loading on the blade root and the disc and such affects its overall lifetime.

Additionally, different areas of the outer shroud are subject to different strength requirements. Therefore, the structural design and the distribution of the mass within the shroud should be balanced for reducing the load on the blade during rotation. Therefore known embodiments comprise for example one or more pockets recessed in the outer surface of a shroud and/or reinforcement structures. Another requirement for the design of a blade is to prevent creep curling of the blade shrouds. Depending on the thickness of the shroud, the shroud edges can curl up at their ends and introduce severe bending stresses in the fillets between the shroud and blade tip. Shrouds curl due to the bending load on the edges of the shroud resulting from gas pressure loads as well as centrifugal loads. An example for a known blade having an outer shroud with a lightweight design is disclosed in the European patent application EP 3 269 932 A1 which refers to a cast-to-size gas turbine blade. Another design challenge arises when hardfacing is provided on at least one edge of the shroud as the hardfacing is subject to circumferential loads that must be supported by the shroud.

SUMMARY OF THE INVENTION

Therefore, it is an object of this invention to provide an improved blade for a turbomachine comprising a hardfacing on at least one edge of the shroud providing a lightweight design on that edge but also sufficient support to the hardfacing.

An improved blade for a turbomachine is achieved by the solution of the independent claim. Further developments of the invention are provided by the subject matter of the dependent claims.

The invention proposes a blade for a turbomachine comprising a shroud which is positioned on a tip side of the blade having an outer surface having at least one circumferential web arranged thereon, at least one pocket recessed in the outer surface of the shroud and a hardfacing provided on at least one edge of the shroud. A first pocket recessed in the outer surface is arranged adjacent to the hardfacing, wherein the first pocket is open to the edge and wherein between the first pocket and the hardfacing a supporting wall is arranged for supporting the hardfacing during contact of the edge of the shroud with the edge of another shroud.

The blade for a turbomachine comprises a shroud which is positioned at its tip side and which extends essentially in the circumferential direction of rotation of the blade disk. The radial outer surface of the shroud is hereinafter referred to as the outer surface of the shroud. At least one circumferential web is arranged circumferentially aligned with regard to the rotation direction of the blade disk and turbomachine, respectively. Usually the radial thickness of such webs is constant in circumferential direction. The design of shrouds having at least one circumferentially aligned web is called dogbone-shaped. Such a design permits a high degree of reinforcement in both the circumferential direction and the axial direction.

At least one first pocket is arranged on the outer surface of the shroud, which is recessed in the outer surface for reducing the mass of the shroud where it is not needed for strength requirements, thereby achieving a weight reduction of the shroud. Depending on the design, the strength requirements are usually achieved by means of (reinforcement) ribs, for example formed by not recessed portions of the shroud and outer shroud surface, respectively. At least one first pocket is open to the edge of the shroud thereby removing material at the end face of the shroud. In connection with this invention, hereinafter the front and end face of the shroud in circumferential direction, respectively, are referred to as "edge" of the shroud. The removing of material at the edge has a great effect on weight saving and better balancing of the shroud due to its distance from the airfoil, with a risk of creep curling of the edge.

The shroud further comprises a hardfacing provided on at least one edge of the shroud. As already explained, on a blade disk the blades are arranged next to each other and contact each other at contact areas arranged at adjacent edges of the shrouds. Usually hardfacing elements are used which are welded into prepared recesses. The forces resulting from contact between the shrouds are transferred via the hardfacing into the shroud and thus into the blade. In the proposed design, during contact of the edge of the shroud with the edge of another shroud the hardfacing is supported by a supporting wall.

For reasons of weight, weight balance and strength of the shroud, a first pocket recessed in the outer surface and open to the edge of the shroud is arranged at a distance from the hardfacing at the other side of a supporting wall. In the proposed shroud design of the blade, the combination of a reduced load of the blade resulting from the open first pocket at the side edge of the shroud, and the supporting wall also serves for preventing creep curling of the edge of the shroud.

A side face of the first pocket joins the supporting wall with a radius corresponding at least to the length of the shorter extension of the supporting wall, in particular at least to 1.5 or 2 times the length of the shorter extension of the supporting wall, and at most to 1.5 times the length of the larger extension of the supporting wall, in particular at most to 1.4 or 1.3 times the length of the larger extension of the supporting wall.

In an embodiment of the blade the radius of the side face of the pocket is about 1.2 times the extension of the hardfacing with respect to (along) the supporting wall, e.g. in the rage of 1.2±0.1 times of this length. This ratio between the radius of the side face of the pocket and the extension of the hardfacing allows for a particular beneficial distribution of the stress within the shroud of the blade.

The radius of the side face of the pocket enables a smooth stress distribution adjacent to the hardfacing area. Thereby, a larger radius distributes the stress to a larger area. For example, the radius can range from 1.5 to 4.0 mm. Hereby it is also possible that at the end face of the shroud, the radius runout joins the supporting wall not yet being parallel to the supporting wall.

The proposed blade for a turbomachine allows a more balanced and lightweight design of the shroud having a hardfacing arranged on at least one edge but also sufficient support for the hardfacing during contacting the adjacent blade and allows for an advantageous stress distribution.

In some embodiments of the blade at least one further pocket is arranged at the outer surface of the shroud, wherein the area between two pockets forms a reinforcement rib. The provision of further pockets allows to further reduce the weight of the outer shroud. When providing further pockets the area between two pockets forms reinforcement ribs which have to be arranged and designed according to strength requirements of the shroud.

Additional pockets and/or ribs can allow for a particularly advantageous designs in terms of stiffness, weight and stress distribution.

In a preferred embodiment the shroud further comprises a closed second pocket and an axially adjacent closed third pocket which are separated by a first reinforcement rib.

"Closed pockets" are confined in lateral direction, i.e. in circumferential and/or axial direction of the turbomachine, e.g. by reinforcements ribs and/or fins, and are thus not open to an edge of the shroud. The lateral direction is perpendicular to the radial direction.

The second pocket and the first pocket can be arranged circumferentially adjacent and can be separated by a second reinforcement rib.

In one of the beformentioned embodiment the shroud can further comprise an open fourth pocket being arranged circumferentially opposite to the first pocket.

Therein, the fourth pocket and the second pocket can be arranged circumferentially adjacent and can be separated by a third reinforcement rib.

In one or more of the beformentioned embodiments the shroud can further comprise an open fifth pocket being arranged circumferentially adjacent to the third pocket and/or axially opposite to the first pocket and being separated from the fifth pocket by a fourth reinforcement rib.

In an embodiment of the blade the supporting wall has a substantially rectangular or rhomboid shape in top view of the shroud. The supporting wall having the rectangular or rhomboid shape serves on the one hand to absorb the forces acting on the hardfacing and on the other hand to transmit and/or distribute them within the shroud. In this context, substantially rectangular or rhomboid means that the supporting wall has two substantially parallel sides, one side facing the hardfacing and the other side facing the first pocket. The edge of the shroud forms one front side of the substantial rectangular or rhomboid shape and an imaginary side, arranged approximately at the end of the hardfacing, in particular parallel to the front side forms the (imaginary) second end side of the rectangular or rhomboid shape. The sides facing the hardfacing and the first pocket include an angle between 0° (parallel) and 30°.

In an embodiment of the blade the shorter side of the supporting wall is arranged at the edge of the shroud. In this embodiment, usually the shorter side of the hardfacing is arranged next to and in line with the front side of the supporting wall at the edge of the shroud such, that the longer side of the hardfacing is supported by the supporting wall.

In an embodiment of the blade, the first pocket has substantially the same extension as the hardfacing with respect to the supporting wall. Also in this design the supporting wall serves apart from supporting the hardfacing also for reinforcement of the shroud with regard to the material reduction resulting from the first pocket.

In an embodiment of the blade the supporting wall extends at an angle $\alpha$ with respect to the circumferential direction. This design allows the supporting wall to absorb forces oriented in circumferential direction and acting on the hardfacing. The closer the angle $\alpha$ is to 90° to the circumferential direction, the more circumferentially directed force the supporting wall can absorb from the hardfacing, in particular forces resulting from contacting a shroud of another blade.

In an embodiment of the blade the first pocket extends from the supporting wall to the circumferential web. In this embodiment the open first pocket extends along a major proportion of the edge of the shroud starting from the supporting wall. This design enables relatively large weight reductions of the shroud in particular on at least one edge while maintaining the required strength.

In an embodiment of the blade the depth of the first pocket with regard to the outer surface is in the range of 0.2 to 0.7 times the total thickness of the shroud in the area of the supporting wall. Also this design enables relatively large weight reductions of the shroud in particular on at least one edge while maintaining the required strength.

In an embodiment of the blade the depth of the first pocket is about 0.5 times the total thickness of the shroud in the area of the supporting wall. Also this design enables relatively large weight reductions of the shroud in particular on at least one edge while maintaining the required strength.

In an embodiment of the blade the edges of the shroud have an essentially Z-shaped design. In this design two adjacent shrouds and contact surfaces, respectively of the shroud are essentially Z-shaped for contacting corresponding contact surfaces of adjacent arranged blades and shrouds, respectively. This design allows adjacent arranged blades comprising a Z-shaped shroud to support each other during operation of the turbomachine or disk provided with accordingly designed blades, thus providing mechanical stability. Undesired bending or twisting of the shrouds and blades, respectively is likewise reduced.

In a further aspect the invention refers to a turbomachine comprising a blade comprising features and characteristics as described in the preceding disclosure referring to a blade for a turbomachine.

BRIEF DESCRIPTION OF THE DRAWING FIGURES

Further advantages, features and possible applications of the present invention will be described in the accompanying drawing figures in which.

DESCRIPTION OF THE INVENTION

Figure 1:
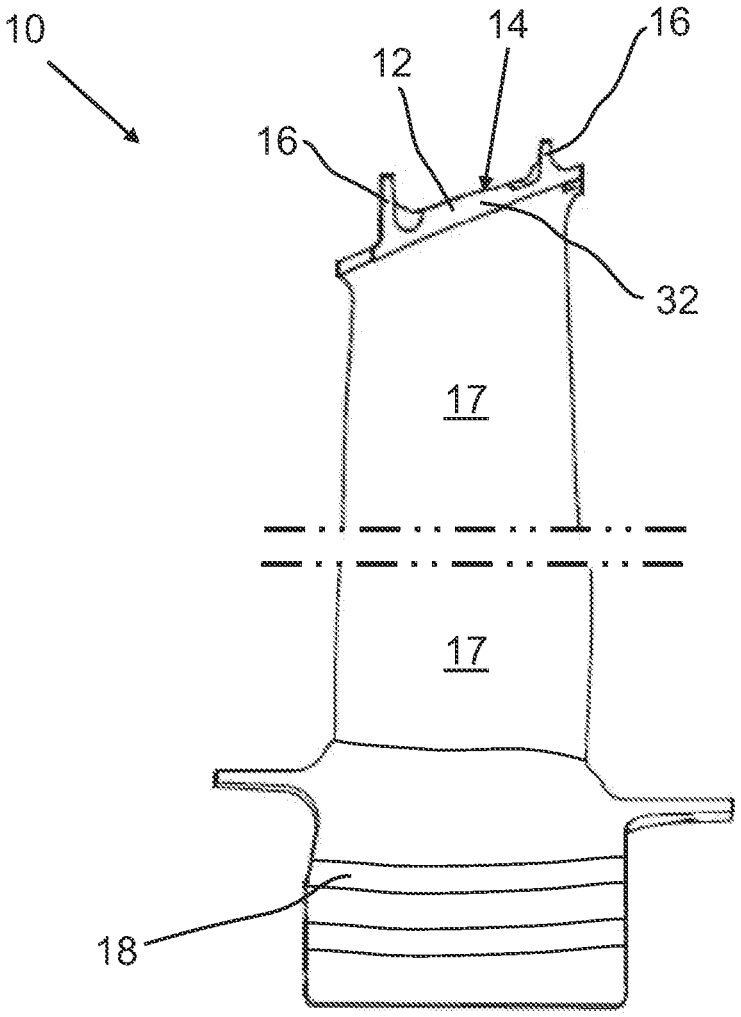
FIG. 1 is a schematic representation of an exemplary blade for a turbomachine having a shroud positioned on the tip side.

FIG. 1 shows a schematic representation of an exemplary blade 10 for a turbomachine having a shroud 12 positioned on the tip side of the blade 10. The shroud 12 comprises an outer surface 14 with two circumferential webs 16 arranged thereon. This design is also called "dogbone"-design allowing a high degree of reinforcement of the shroud 12 and the blade 10, respectively in both the circumferential direction and the axial direction. On the opposite side of the blade tip, where the shroud 12 is positioned, the blade root 18 is arranged. Between the blade root 10 and the shroud 12, the airfoil 17 of the blade 10 is arranged.

Figure 2:
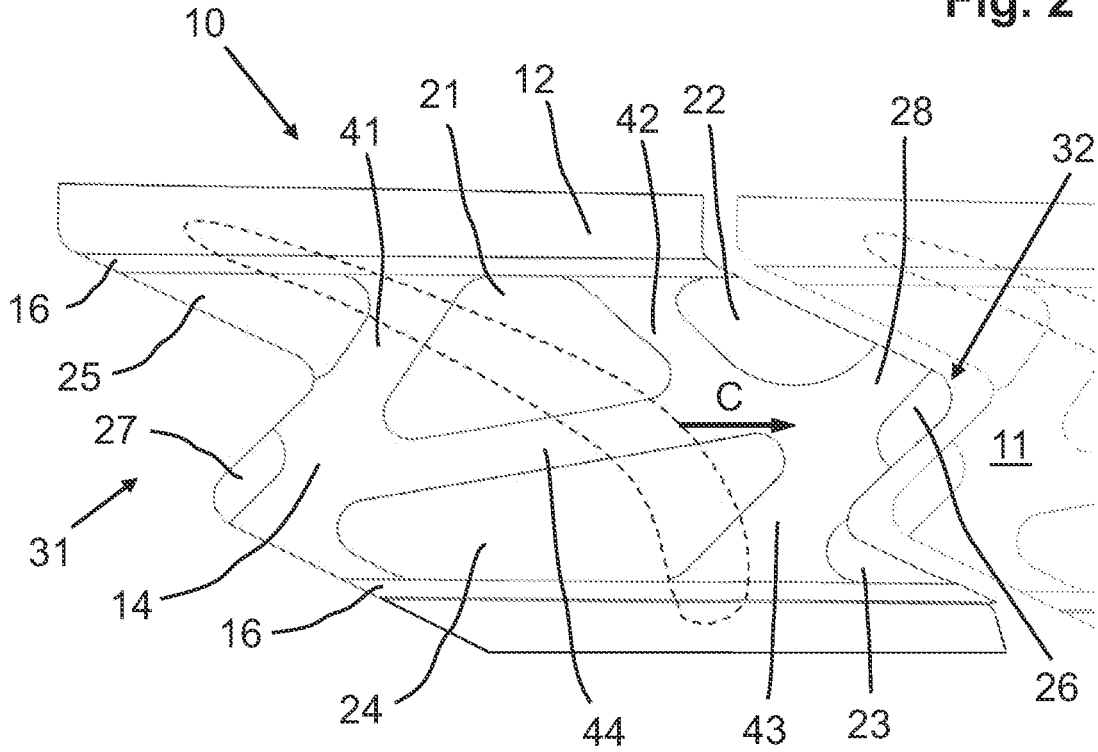
FIG. 2 is a top view on the surface of the shroud of the exemplary blade shown in FIG. 1.

FIG. 2 shows a top view on the shroud 12 of the exemplary blade 10 shown in FIG. 1. The shroud of the exemplary embodiment comprises several pockets 21, 22, 23, 24, 25 recessed in the outer surface 14 and two hardfacings 26, 27 provided at each edge 31, 32 of the shroud 12. A first pocket 22 recessed in the outer surface 14 is open to the edge 32 and is arranged adjacent to the hardfacing 26. Between the first pocket 22 and the hardfacing 26 a supporting wall 28 is arranged for supporting the hardfacing 28 during contact of the edge 32 of the shroud 12 with the edge of another shroud 11 (schematically indicated at the right hand sight). The shroud 12 of the blade 10 also comprises further pockets 21, 23, 24, 25 which are arranged at the outer surface 14 of the shroud 12 and the areas between two pockets 21, 22, 23, 24, 25 form reinforcement ribs 41, 42, 43, 44. As is also shown in FIG. 2, the edges 31, 32 of the exemplary embodiment of the shroud 12 have an essentially Z-shaped design.

In particular, as illustrated in FIG. 2, the shroud 12 further comprises a closed second pocket 21 and an axially adjacent closed third pocket 24 which are separated by a first reinforcement rib 44. The second pocket 21 and the first pocket 22 are arranged circumferentially adjacent and separated by a second reinforcement rib 42.

In the example of FIG. 2 the shroud 12 further comprises an open fourth pocket 25 which is arranged circumferentially opposite to the first pocket 22.

The fourth pocket 25 and the second pocket 21 are arranged circumferentially adjacent and separated by a third reinforcement rib 41.

In the example of FIG. 2 the shroud 12 further comprises an open fifth pocket 23 which is arranged circumferentially adjacent to the third pocket 24 and axially opposite to the first pocket 22 and which is separated from the fifth pocket 23 by a fourth reinforcement rib 43.

Figure 3:
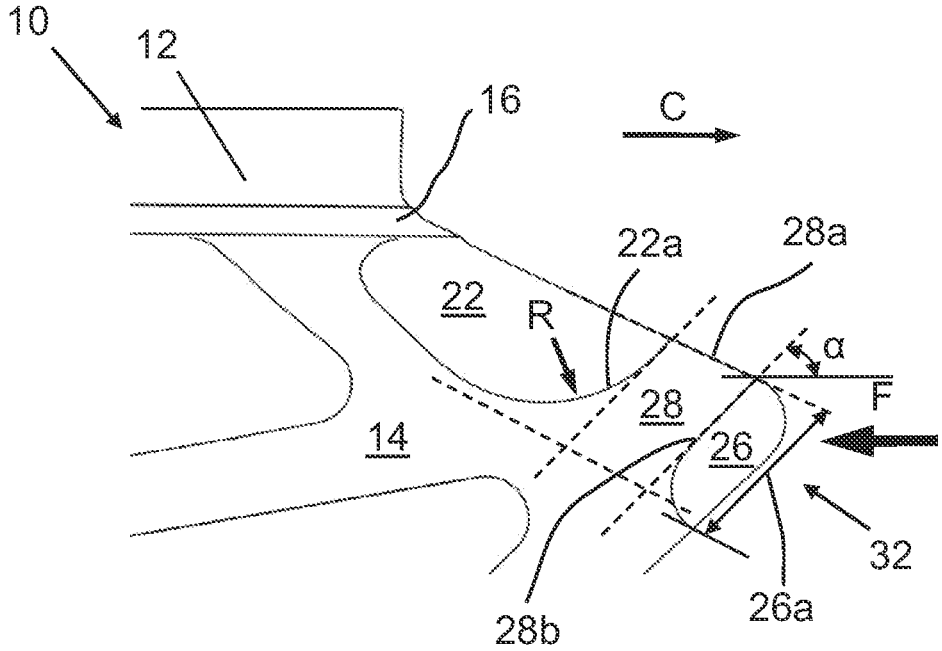
FIG. 3 is a detail of the top view of the shroud of FIG. 2.

FIG. 3 shows a detail of the top view of the shroud of FIG. 2. FIG. 3 shows the edge 32 of shroud 12 and the first pocket 22 in more detail. In the exemplary embodiment of the blade 10, the supporting wall 28 has a substantially rhomboid shape in top view of the shroud 12, wherein the shorter side of the supporting wall 28 is arranged at the edge 32 of the shroud 12. The first pocket 22 is recessed into the outer surface 14 of the shroud 12 and has substantially the same extension as the hardfacing 26 with respect to the supporting wall 28.

In the exemplary embodiment, the supporting wall 28 extends at an angle $\alpha$ with respect to the circumferential direction C. As is shown in FIG. 3, the supporting wall 28 is arranged at an angle $\alpha$ of about 45° with regard to the circumferential direction. This design allows the supporting wall 28 to absorb forces F oriented in circumferential direction C and acting on the hardfacing 26 as in particular forces resulting from contacting a shroud 11 of another blade.

The side face 22*a* of the first pocket 22 joins the supporting wall 28 with a radius R in particular corresponding at least to the length of the shorter extension 28*a* of the supporting wall 28 and at most to 1.5 times to the length of the larger extension 28*b* of the supporting wall 28. In the exemplary embodiment the radius R of the side face 22*a* of the first pocket 22 is about 1.2 times the extension 26*a* of the hardfacing 26 with respect to the supporting wall 28. The first pocket 22 of the exemplary embodiment shown in FIG. 3 extends from the supporting wall 28 to the circumferential web 16. The depth of the first pocket 22 with regard to the outer surface 14 is in the range of 0.2 to 0.7 times and in particular about 0.5 times the total thickness of the shroud 12 in the area of the supporting wall 28.

It would be appreciated by those skilled in the art that various changes and modifications can be made to the illustrated embodiments without departing from the spirit of the present invention. All such modifications and changes are intended to be covered by the appended claims.

What is claimed is:

1. A blade for a turbomachine, comprising a shroud which is positioned on a tip side of the blade having an outer surface having at least one circumferential web arranged thereon, at least one pocket recessed in the outer surface and a hardfacing provided on at least one edge of the shroud wherein a first pocket is radially inwardly recessed in the outer surface and is arranged adjacent to the hardfacing wherein the pocket is open to the edge and wherein between the pocket and the hardfacing a supporting wall, having a shorter extension and a larger extension, is arranged for supporting the hardfacing during contact of the edge of the shroud with the edge of another shroud, wherein a side face of the pocket joins the supporting wall with a radius corresponding at least to the length of the shorter extension of the supporting wall and at most to 1.5 times the length of the a larger extension of the supporting wall.

2. The blade for a turbomachine according to claim 1, wherein the shroud further comprises a closed second pocket and an axially adjacent closed third pocket which are separated by a first reinforcement rib.

3. The blade for a turbomachine according to claim 2, wherein the second pocket and the first pocket being arranged circumferentially adjacent and separated by a second reinforcement rib.

4. The blade for a turbomachine according to claim 1, wherein the shroud further comprises an open fourth pocket being arranged circumferentially opposite to the first pocket.

5. The blade for a turbomachine according to claim 4, wherein the fourth pocket and the second pocket are arranged circumferentially adjacent and separated by a third reinforcement rib.

6. The blade for a turbomachine according to claim 1, wherein the shroud further comprises an open fifth pocket being arranged circumferentially adjacent to the third pocket and/or axially opposite to the first pocket and being separated from the fifth pocket by a fourth reinforcement rib.

7. The blade for a turbomachine according to claim 1, wherein the supporting wall has a substantially rectangular or rhomboid shape in top view of the shroud.

8. The blade for a turbomachine according to claim 7, wherein the shorter side of the supporting wall is arranged at the edge of the shroud.

9. The blade for a turbomachine according to claim 1, wherein the first pocket has substantially the same extension as the hardfacing with respect to the supporting wall.

10. The blade for a turbomachine according to claim 1, wherein the supporting wall extends at an angle with respect to a circumferential direction.

11. The blade for a turbomachine according to claim 1, wherein the first pocket extends from the supporting wall to the circumferential web.

12. The blade for a turbomachine according to claim 6, wherein the depth of at least one of the first pocket, second pocket, third pocket, fourth pocket and the fifth pocket, with regard to the outer surface, is in the range of 0.2 to 0.7 times the total thickness of the shroud in the area of the supporting wall.

13. The blade for a turbomachine according to claim 1, wherein the edges of the shroud have a substantially Z-shaped design.

14. The blade for a turbomachine according to claim 1, wherein the blade is configured and arranged in a turbomachine.

* * * * *